US009829842B2

(12) United States Patent
Kajita

(10) Patent No.: US 9,829,842 B2
(45) Date of Patent: Nov. 28, 2017

(54) FIXING DEVICE

(71) Applicant: Brother Kogyo Kabushiki Kaisha, Nagoya-shi, Aichi-ken (JP)

(72) Inventor: Masahito Kajita, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/259,528

(22) Filed: Sep. 8, 2016

(65) Prior Publication Data

US 2017/0090367 A1 Mar. 30, 2017

(30) Foreign Application Priority Data

Sep. 30, 2015 (JP) ..... 2015-193911

(51) Int. Cl.
*G03G 15/20* (2006.01)

(52) U.S. Cl.
CPC ..... *G03G 15/2053* (2013.01); *G03G 15/2017* (2013.01); *G03G 2215/2035* (2013.01)

(58) Field of Classification Search
CPC ..... G03G 15/2053; G03G 15/2017; G03G 2215/2035
See application file for complete search history.

(56) References Cited

U.S. PATENT DOCUMENTS

2011/0158716 A1* 6/2011 Fujiwara ..... G03G 15/2053 399/329
2014/0153982 A1* 6/2014 Adachi ..... G03G 15/2028 399/329
2015/0093165 A1* 4/2015 Kondo ..... G03G 15/206 399/329
2016/0091852 A1* 3/2016 Matsuno ..... G03G 15/657 399/322
2016/0109834 A1* 4/2016 Kadowaki ..... G03G 15/2053 399/329
2016/0274511 A1* 9/2016 Ogino ..... G03G 15/2053

FOREIGN PATENT DOCUMENTS

JP 2000-321901 A 11/2000
JP 2006-058527 A 3/2006

* cited by examiner

*Primary Examiner* — Ryan Walsh
(74) *Attorney, Agent, or Firm* — Banner & Witcoff, Ltd.

(57) ABSTRACT

A nip member is disposed inside the endless belt and elongated in a longitudinal direction. A backup member sandwiches the endless belt against the nip member to form a nip portion at which the backup member and the endless belt are in contact with each other and configured to convey a recording sheet in a conveying direction perpendicular to the longitudinal direction. A downstream end of the nip portion in the conveying direction is arced with a longitudinal center portion thereof further upstream than longitudinal end portions thereof. The nip member includes a first portion sandwiching the endless belt against the backup member, and a second portion positioned downstream of the first portion in the conveying direction and bent in a direction away from the backup member. The second portion is arced with a longitudinal center portion thereof further upstream in the conveying direction than longitudinal end portions thereof.

13 Claims, 13 Drawing Sheets

FIXING DEVICE

CROSS-REFERENCE TO RELATED APPLICATION

This application claims priority from Japanese Patent Application No. 2015-193911 filed on Sep. 30, 2015, the content of which is incorporated herein by reference in its entirety.

FIELD OF DISCLOSURE

Aspects of the disclosure relate to a fixing device configured to thermally fix a developer image onto a recording sheet.

BACKGROUND

A known fixing device includes an endless belt rotating about its axis, a ceramic heater disposed inside the endless belt and having a rectangular shape elongated in an axial direction of the endless belt, and a pressure roller sandwiching the endless belt against the ceramic heater to form a nip portion. A sheet is conveyed in a conveying direction while being sandwiched by the endless belt and the pressure roller, and is separated from the endless belt at a downstream end of the ceramic heater.

SUMMARY

In the above-described configuration, it is conceivable that longitudinal opposite ends of the ceramic heater are configured to be urged toward the pressure roller. In this case, a longitudinal center portion of the ceramic heater may be deformed in a direction away from the pressure roller, causing uneven pressure distribution, in the longitudinal direction, at the nip portion, which may be result in variation in quality of an image fixed on a sheet.

It may be beneficial to provide a fixing device configured to properly separate a sheet having an image fixed thereon from an endless belt while reducing variation in quality of an image fixed on the sheet.

According to one or more aspects of the disclosure, a fixing device comprises an endless belt, a nip member disposed inside the endless belt and elongated in a longitudinal direction, and a backup member sandwiching the endless belt against the nip member to form a nip portion at which the backup member and the endless belt are in contact with each other and are configured to convey a recording sheet in a conveying direction perpendicular to the longitudinal direction. A downstream end of the nip portion in the conveying direction is arced with a longitudinal center portion thereof further upstream than longitudinal end portions thereof. The nip member includes a first portion sandwiching the endless belt against the backup member, and a second portion positioned downstream of the first portion in the conveying direction and bent in a direction away from the backup member, the second portion being arced with a longitudinal center portion thereof further upstream in the conveying direction than longitudinal end portions thereof.

According to one or more aspects of the disclosure, a fixing device comprises an endless belt, a nip member disposed inside the endless belt and elongated in a longitudinal direction, and a backup member sandwiching the endless belt against the nip member to form a nip portion at which the backup member and the endless belt are in contact with each other and are configured to convey a recording sheet in a conveying direction perpendicular to the longitudinal direction. The nip member includes a first flat portion sandwiching the endless belt against the backup member and having a first curvature radius, a first corner positioned downstream of the first flat portion in the conveying direction and bent in a direction away from the backup member, and a second corner positioned between the first flat portion and the first corner in the conveying direction and sandwiching the endless belt against the backup member. The second corner has a second curvature radius smaller than the first curvature radius. Each of the first corner and the second corner is arced with a longitudinal center portion thereof further upstream in the conveying direction than longitudinal end portions thereof, such that the first corner is equidistant from the second corner in the conveying direction across the longitudinal direction of the nip member.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

An illustrative embodiment according to one or more aspects of the disclosure will be described below with reference to the accompanying figures. The disclosure is merely an example and various changes, arrangements and modifications may be applied without departing from the spirit and scope of the disclosure. The overall structure of a color printer 1 will be described first, and then various parts thereof will be described in detail.

For ease of discussion, in the following description, the top or upper side, the bottom or lower side, the left or left side, the right or right side, the front or front side, and the rear or rear side of the color printer 1 will be identified as indicated by the arrows in FIG. 1.

Figure 1:
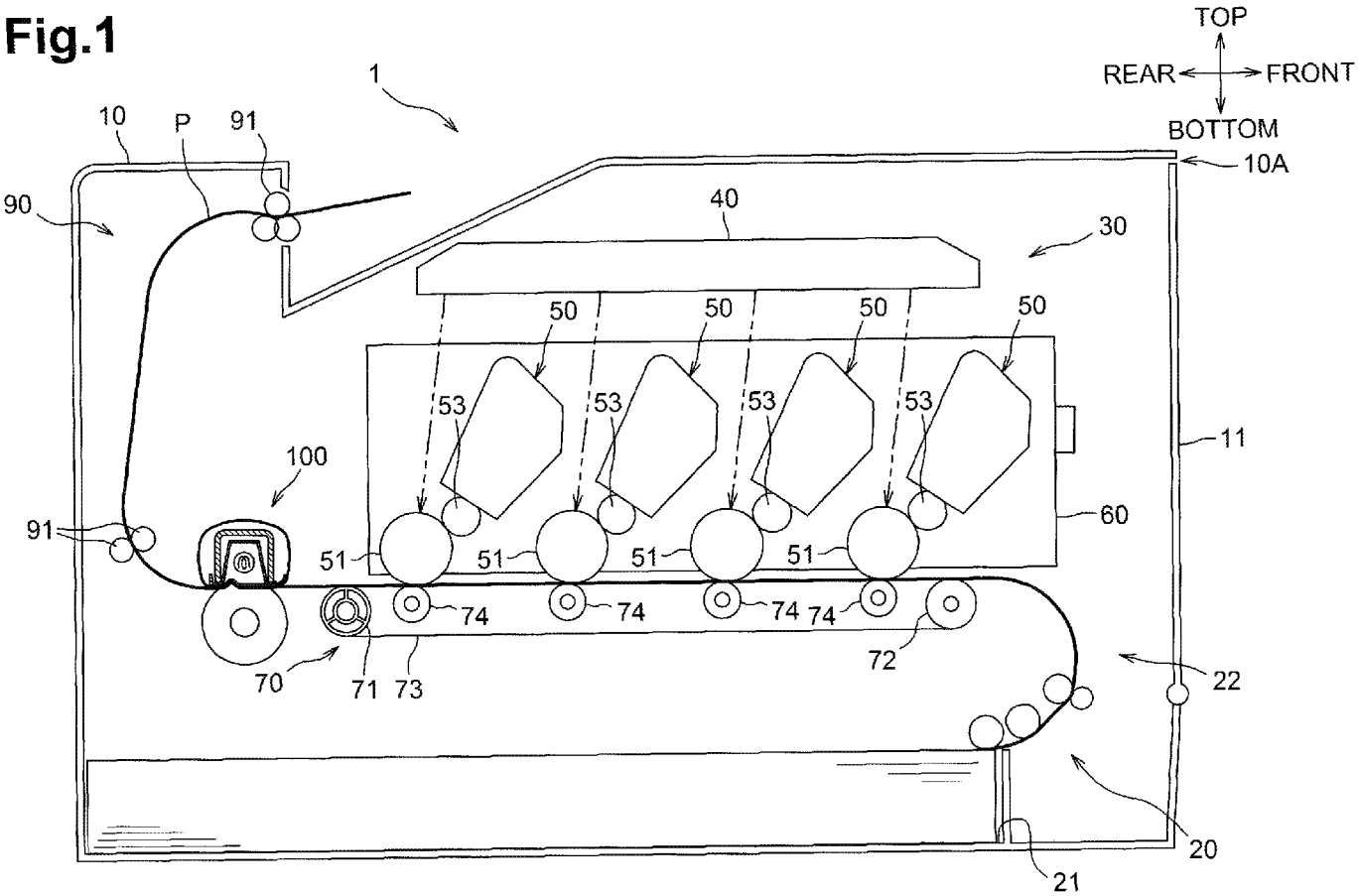
FIG. 1 is a sectional view of a color laser printer including a fixing device according to an illustrative embodiment.

As shown in FIG. 1, the color printer 1 includes, in a housing 10, a sheet feeder 20 configured to feed a recording sheet, e.g., a sheet P, an image forming unit 30 configured to form an image on the sheet P fed by the sheet feeder 5, and a discharge unit 90 configured to discharge the sheet P having the image formed thereon.

The sheet feeder 20 includes a feed tray 21 configured to store sheets P therein, and a sheet conveying mechanism 22 configured to convey a sheet P from the feed tray 21.

The image forming unit 30 includes a scanning unit 40, four process cartridges 50, a holder 60, a transfer unit 70, and a fixing device 100.

The scanning unit 40 is disposed in an upper portion of the housing 10 and includes laser emitters, a polygon mirror, lenses, and reflective mirrors, which are not shown. The scanning unit 40 scans a laser beam at high speed on a surface of each photosensitive drum 51.

The process cartridges 50 are disposed above the sheet feeder 20 and arranged in a front-rear direction. Each process cartridge 50 includes a photosensitive drum 51, a charger, a developing roller 53, and a toner storage, which are not shown.

The holder 60 for holding the four process cartridges 50 collectively is movable in the front-rear direction through an opening 10A which is formed when a front cover 11 is open.

The transfer unit 70 is disposed between the sheet feeder 20 and the four process cartridges 50, and includes a driving roller 71, a driven roller 72, a conveyor belt 73, and transfer rollers 74.

The driving roller 71 and the driven roller 72 are spaced from each other in the front-rear direction and parallel to each other. The conveyor belt 73, which is endless, is looped under tension around the driving roller 71 and the driven roller 72. The transfer rollers 74 are disposed inside a loop of the conveyor belt 73 such that the transfer rollers 74 face the respective photosensitive drums 51 via the conveyor belt 73 sandwiched therebetween.

The fixing device 100 is disposed at the rear of the four process cartridges 50 and the transfer unit 70. The fixing device 100 will be described later.

In the image forming unit 30, each charger (not shown) uniformly charges the surface of a corresponding rotating photosensitive drum 51. The scanning unit 40 emits a laser beam to the surface of each photosensitive drum 51 to expose the surface with the laser beam. As a result, a static latent image is formed based on image data on the surface of each photosensitive drum 51.

Consequently, each developing roller 53 is driven to rotate to supply toner to the static latent image on a corresponding photosensitive drum 51, thereby forming a toner image on the surface of the corresponding photosensitive drum 51. Thereafter, each toner image is sequentially transferred onto a sheet P fed from the sheet feeder 20 when the sheet P is conveyed between each photosensitive drum 51 and a corresponding transfer roller 74. The fixing device 100 thermally fixes the transferred toner images onto the sheet P.

The discharge unit 90 includes a plurality of conveying rollers 91. The sheet P having the toner images thermally fixed thereon is discharged from the housing 10 by the conveying rollers 91.

Figure 2:
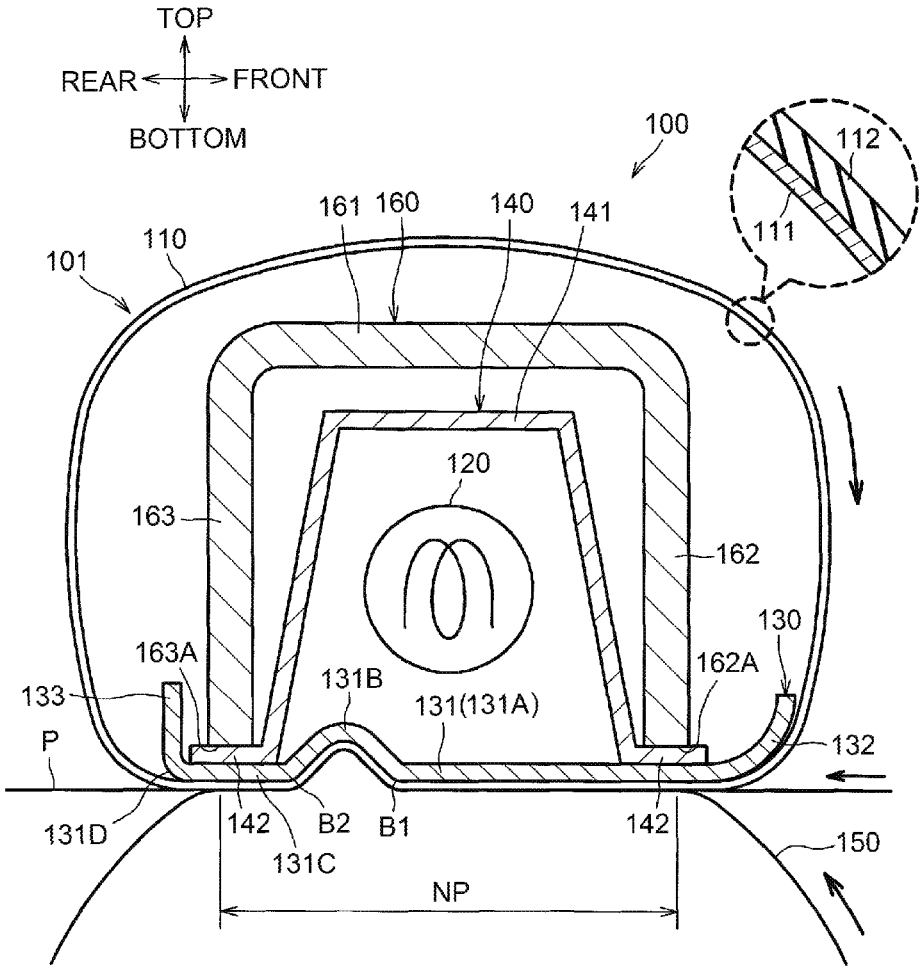
FIG. 2 is a cross-sectional view of the fixing device.

As shown in FIG. 2, the fixing device 100 includes a heating unit 101 and a pressure roller 150 (as an example of a backup member). The heating unit 101 heats the sheet P having the toner images formed thereon. The pressure roller 150 and the heating unit 101 form a nip portion NP therebetween. At the nip portion NP, the fixing device 100 is configured to convey the sheet P in a predetermined conveying direction. In the illustrative embodiment, the sheet P is conveyed in a conveying direction which is substantially corresponds to the front-rear direction.

The heating unit 101 includes an endless belt 110, a halogen lamp 120 (as an example of a heater), a nip plate 130 (as an example of a nip member), a reflective plate 140 (as an example of a reflective member), and a stay 160 (as an example of a support member). The halogen lamp 120, the nip plate 130, the reflective plate 140, and the stay 160 are disposed inside the endless belt 110.

The endless belt 110 has heat resistance and flexibility, and is shaped like a cylinder having a central axis extending in the right-left direction. A width in the right-left direction of the endless belt 110 is larger than a diameter thereof. The endless belt 110 includes a metal layer 111 and an elastic layer 112. In the following description, the right-left direction is also referred to as an axial direction.

The metal layer 111 is made of metal, such as stainless steel, and is disposed inside the elastic layer 112 in a thickness direction of the endless belt 110. An inner peripheral surface of the metal layer 111 is in contact with the nip plate 130. Grease is applied to the inner peripheral surface of the metal layer 111 to reduce frictional resistance exerted between the metal layer 111 and the nip plate 130. A pair of side guides 180 (refer to FIG. 4) guides opposite ends in the right-left direction of the metal layer 111.

The elastic layer 112 is closely attached to the outside of the metal layer 111 in the thickness direction of the endless belt 110. The elastic layer 112 is made of rubber, such as silicone rubber, having peelability and elasticity. An outer peripheral surface of the elastic layer 112 is in contact with the pressure roller 150. A non-metallic release layer made of fluorine resin may be additionally provided, by fluorine coating, on the outer peripheral surface of the elastic layer 112.

The halogen lamp 120 is a heater for heating toner on a sheet P by heating the endless belt 110 via the nip plate 130. The halogen lamp 120 is disposed, inside the endless belt 110, at a specified distance from the nip plate 120.

The nip plate 130 sandwiches the endless belt 110 against the pressure roller 150 to form a nip portion NP between the endless belt 110 and the pressure roller 150. The nip plate 130 is plate-shaped and elongated in the axial direction of the endless belt 110 and is disposed below the halogen lamp 120. The nip plate 130 transmits radiant heat received from the halogen lamp 120 to the toner on the sheet P via the endless belt 110. A longitudinal direction of the nip plate 130 is parallel to the axial direction of the endless belt 110.

The nip plate 130 includes a metal plate and a surface layer which covers the metal plate and contacts the inner peripheral surface of the endless belt 110. The surface layer may be made by non-metallic or metallic plating or by fluorine resin coating.

The nip plate 130 may be made from a metal plate, such as an aluminum plate, having higher thermal conductivity than the stay 160 which is made of stainless steel, as described later. The nip plate 130 is bent into a substantially U-shape in cross-section. More specifically, the nip plate 130 includes a base 131 extending substantially along the front-rear direction, and flanges 132, 133 bent upward from front and rear ends of the base 131 respectively, in cross-section.

The base 131 includes a first flat portion 131A (as an example of a first portion), a recessed portion 131B (as an example of a fourth portion), a second flat portion 131C, and a corner 131D (as an example of a second portion). The first flat portion 131A, the recessed portion 131B, and the second flat portion 131C sandwich the endless belt 110 against the pressure roller 150 to form the nip portion NP. The corner 131D is positioned away from and downstream of the nip portion NP in the conveying direction. At the nip portion NP, the endless belt 110 and the pressure roller 150 are in contact with each other.

In a cross-section taken along a plane perpendicular to the right-left direction, a width of the recessed portion 131B in the conveying direction may be in a range from 0.5 mm to 5.0 mm, or in a range from 1.0 mm to 3.0 mm, or in a range from 1.0 mm to 2.0 mm and substantially uniform over the length in the right-left direction of the nip plate 130. In a cross-section taken along a plane perpendicular to the right-left direction, a depth of the recessed portion 131B may be in a range from 0.5 mm to 5.0 mm, or in a range from 1.0 mm to 3.0 mm, or in a range from 1.0 mm to 3.0 mm and substantially uniform over the length in the right-left direction of the nip plate 130.

The first flat portion 131A is a flat plate-like portion substantially perpendicular to the top-bottom direction. The first flat portion 131A extends, in the conveying direction, from a front wall 162 of the stay 160 (to be described later) to a vicinity of the halogen lamp 120. A lower surface of the first flat portion 131A, which is a contact surface with the endless belt 110, is substantially flat. Herein, "substantially flat" indicates that the lower surface has a curvature smaller than the curvature of the pressure roller 150 without any load applied thereto. The lower surface of the first flat portion 131A has a curvature radius largest among the curvature radii of all surfaces of the nip plate 130 which form the nip portion NP.

The recessed portion 131B is positioned between a rear wall 163 of the stay 160 and the halogen lamp 120 in the conveying direction, and recessed upward (in a direction away from the pressure roller 150) from a downstream end of the first flat portion 131A in the conveying direction. An upstream end B1 and a downstream end B2 of the lower surface of the recessed portion 131B form corners. The curvature radii of the upstream end B1 and the downstream end B2 are smaller than the curvature radius of the lower surface of the first flat portion 131A. More specifically, the curvature radii of the upstream end B1 and the downstream end B2 are smaller than the curvature radius of a bottom surface of the recessed portion 131B.

The second flat portion 131C is a flat plate-like portion substantially perpendicular to the top-bottom direction. The second flat portion 131C extends downstream in the conveying direction from the downstream end B2 of the recessed portion 131B. Similarly to the first flat portion 131A, a lower surface of the second flat portion 131C is substantially flat.

The corner 131D is curved upward from a downstream end of the second flat portion 131C. A lower surface of the corner 131D has a curvature radius smaller than the curvature radii of the lower surfaces of the first flat portion 131A and the second flat portion 131C. In other words, the corner 131D is bent in a direction away from the pressure roller 150. Because the curvature changes drastically from the second flat portion 131C to the corner 131D, a sheet P is likely to be separated from the endless belt 110. The corner 131D defines a separation point at which the sheet P is separated.

Figure 3:
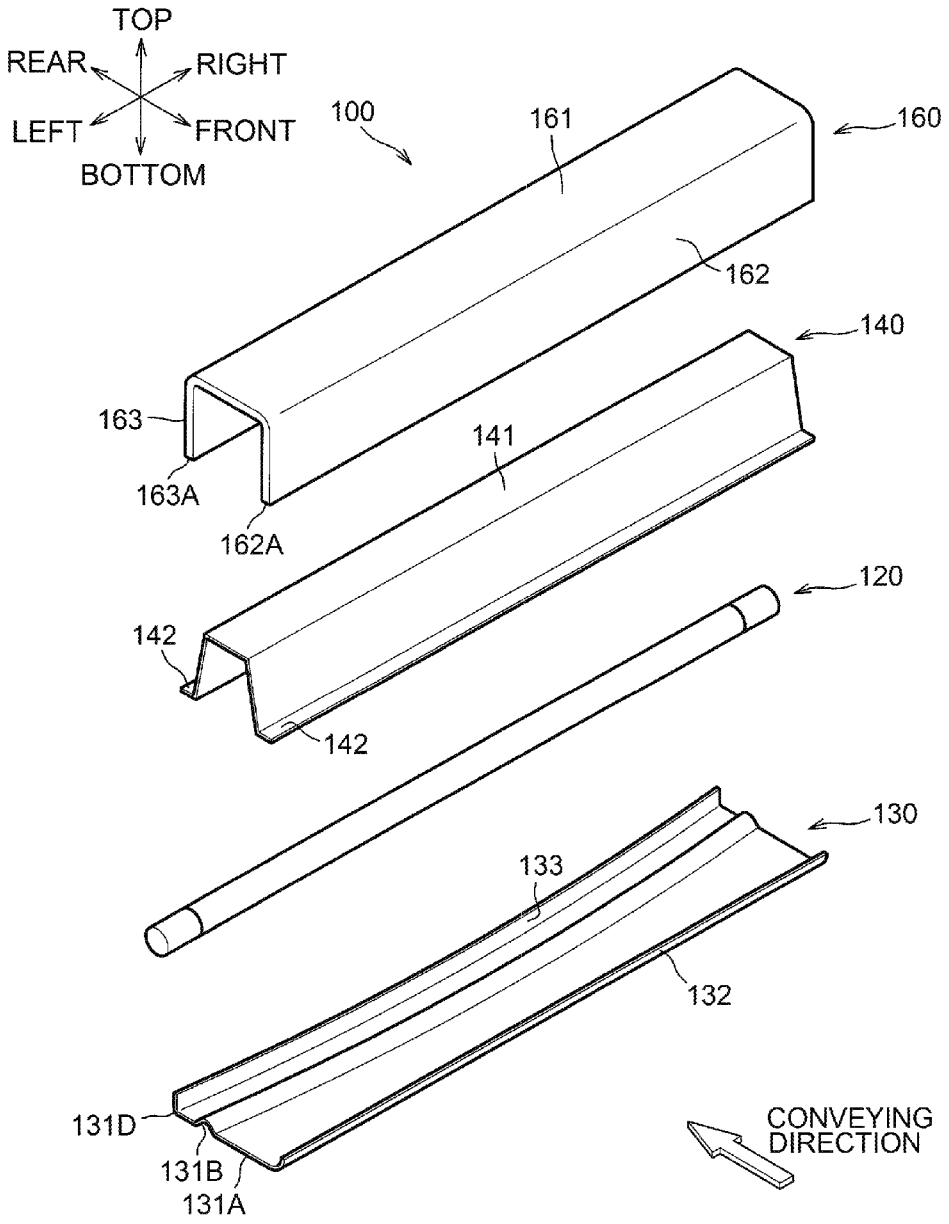
FIG. 3 is an exploded perspective view of a nip plate and other components of a heating unit.
Figure 5:
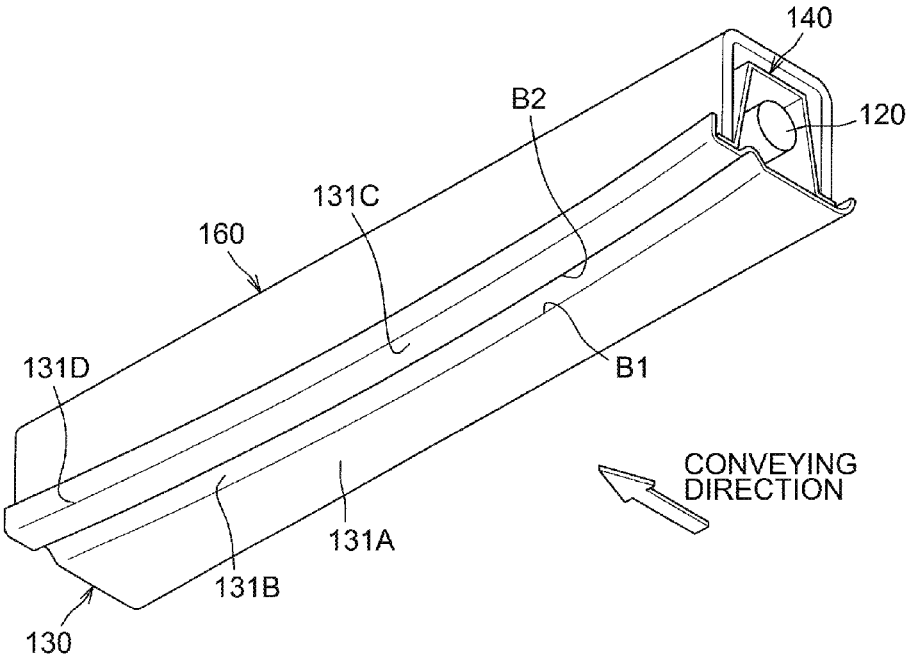
FIG. 5 is a bottom perspective view of the nip plate and other components of the heating unit.

As shown in FIGS. 3 and 5, when viewed in the top-bottom direction, each of the corner 131D and the recessed portion 131B is shaped like an arc and is arced with its longitudinal center portion further upstream in the conveying direction than its longitudinal end portions. When viewed in the top-bottom direction, each of the upstream end B1 and the downstream end B2 of the lower surface of the recessed portion 131B is shaped like an arc and is arced with its longitudinal center portion further upstream in the conveying direction than its longitudinal end portions. Herein, an arc is symmetrical relative to a conveying centerline of the sheet P (a centerline with respect to the right-left direction) and is crowned across a conveying area (a width in the right-left direction) of the sheet P.

Figure 6:
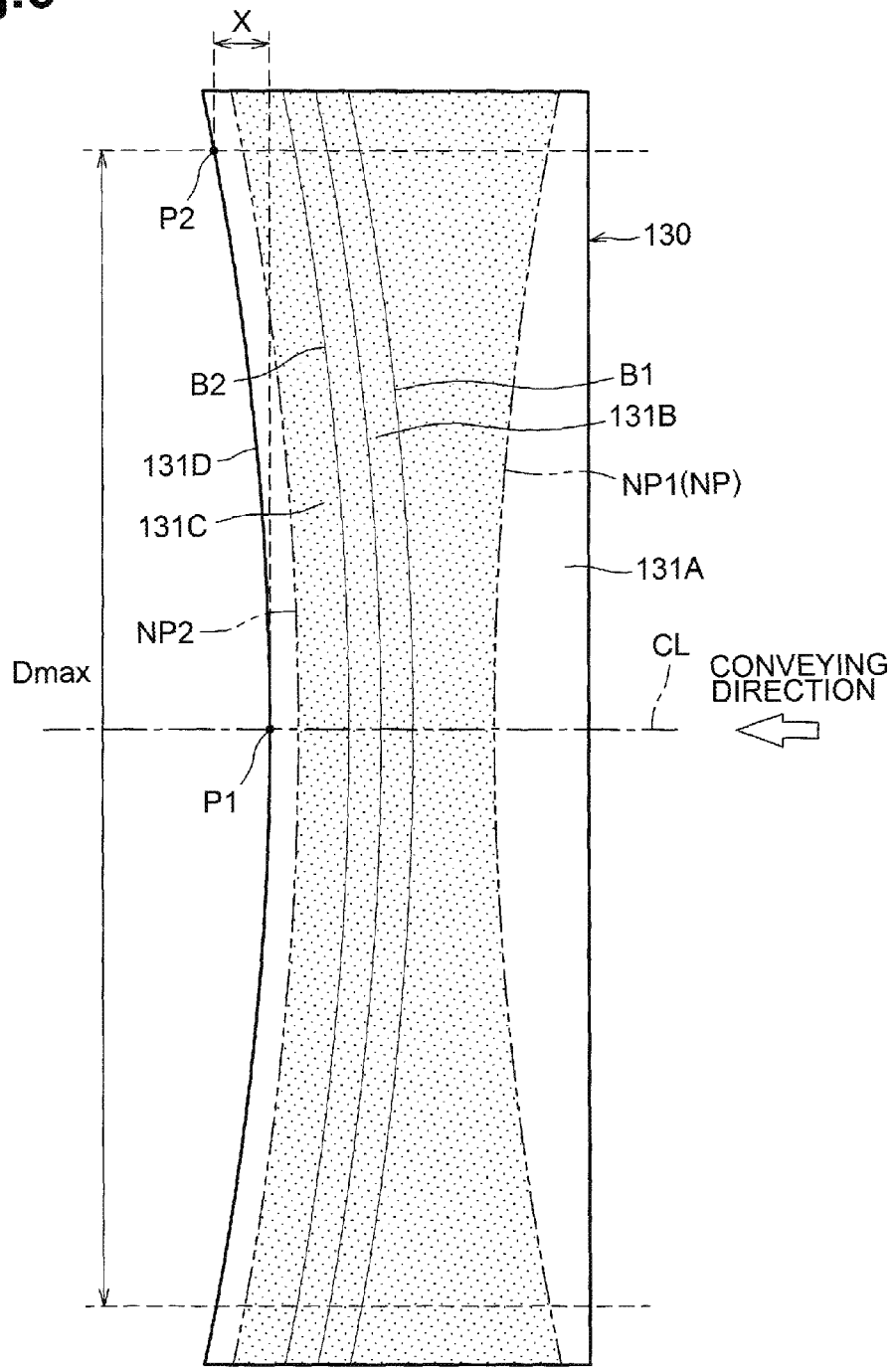
FIG. 6 is a schematic diagram showing a shape of a corner of the nip plate.

As shown FIG. 6, a conveying centerline CL indicates a center with respect to a direction (right-left direction) perpendicular to the conveying direction of a sheet in a maximum-size sheet conveying area (a range indicated by Dmax) at the nip portion NP. A maximum-size sheet indicates a sheet usable in the printer and may be, for example, a letter-size sheet or an A3-size sheet.

The corner 131D intersects at a point P1 with the conveying center line CL, and intersects at a point P2 with an end of the maximum-size sheet conveying area. In this case, the crown amount CR is represented by the following equation: CR=X/Dmax, where X is a distance between the point P1 and the point P2 in the conveying direction, and Dmax is a length in the right-left direction of the maximum-size sheet conveying area. The point P1 is positioned upstream of the point P2 in the conveying direction.

Although, in the illustrative embodiment, the crown amount CR is 0.02, the crown amount CR may be in a range from 0.001 to 0.5, or in a range from 0.005 to 0.3, or in a range from 0.01 to 0.1.

Referring back to FIG. 2, the upstream flange 132 extends arcuately frontward and upward from an upstream end of the first flat portion 131A. The flange 132 has a curvature radius larger than the curvature radius of the corner 131D.

The downstream flange 133 extends upward from an upper end of the corner 131D. Similarly to the corner 131D, as shown in FIG. 3, the flange 133 is arced with its longitudinal center portion further upstream in the conveying direction than its longitudinal end portions.

The reflective plate 140 is configured to reflect radiant heat from the halogen lamp 120 toward the nip plate 130 and is disposed inside the endless belt 110 at a specified distance from the halogen lamp 120 to surround the halogen lamp 120.

The reflective plate 140 is formed by bending, in a substantially U-shape in cross section, a metal plate, e.g., an aluminum plate, having high infrared and far-infrared reflectance. The reflective member 140 may be formed from an aluminum plate polished to a mirror-smooth state to increase heat reflectance.

More specifically, the reflective plate 140 includes a reflective portion 141 having a substantially U-shape in cross section, and flange portions 142 extending upstream and downstream in the conveying direction from respective lower ends of the reflective portion 141. As shown in FIG. 3, each of the flange portions 142 extends longitudinally from one end to the other end of the nip plate 130.

Referring back to FIG. 2, a stay 160 supports opposite ends, in the conveying direction, of a base 131 of the nip plate 130, via the respective flange portions 142, to ensure stiffness of the nip plate 130. The stay 160 is disposed opposite to the pressure roller 150 relative to the nip plate 130. The stay 160 is formed by bending, in a substantially U-shape in cross section, a metal plate, e.g., a steel plate, having relatively high stiffness.

The stay 160 includes an upper wall 161, a front wall 162 extending downward from a front end of the upper wall 161, and a rear wall 163 extending downward from a rear end of the upper wall 161. The stay 160 has a substantially U-shape in cross section and is disposed covering the reflective plate 140. Lower surfaces of the front wall 162 and the rear wall 163 support, respectively, as support surfaces 162A, 163A, the nip plate 130, via the flange portions 142 of the reflective plate 140. As shown in FIG. 3, each of the support surfaces 162A, 163A extends along the nip plate 130 longitudinally from one end to the other end of the nip plate 130. The support surfaces 162A, 163A face the first flat portion 131A and the second flat portion 131C, respectively.

The support surface 163A of the stay 160 and the flange portion 142 of the reflective plate 140, which extend straight longitudinally, are placed between the flange 133 and the recessed portion 131B, which are arced when viewed from the top. For the purpose of illustration, in FIG. 3, an amount of a longitudinal center portion of each of the flange 133 and the recessed portion 131B being arced upstream in the conveying direction relative to longitudinal end portions thereof is shown in an exaggerated manner and may actually be less than that shown in FIG. 3.

Referring back to FIG. 2, the pressure roller 150 is elastically deformable and is disposed below the nip plate 130. The pressure roller 150 sandwiches, in an elastically deformed state, the endless belt 110 against the nip plate 130, thereby forming the nip portion NP between the pressure roller 150 and the endless belt 110.

The pressure roller 150 is configured to be driven, by a motor (not shown) disposed in the housing 10, to rotate the endless belt 110 due to friction between the pressure roller 150 and the endless belt 110 or a sheet P on the endless belt 110.

Figure 4:
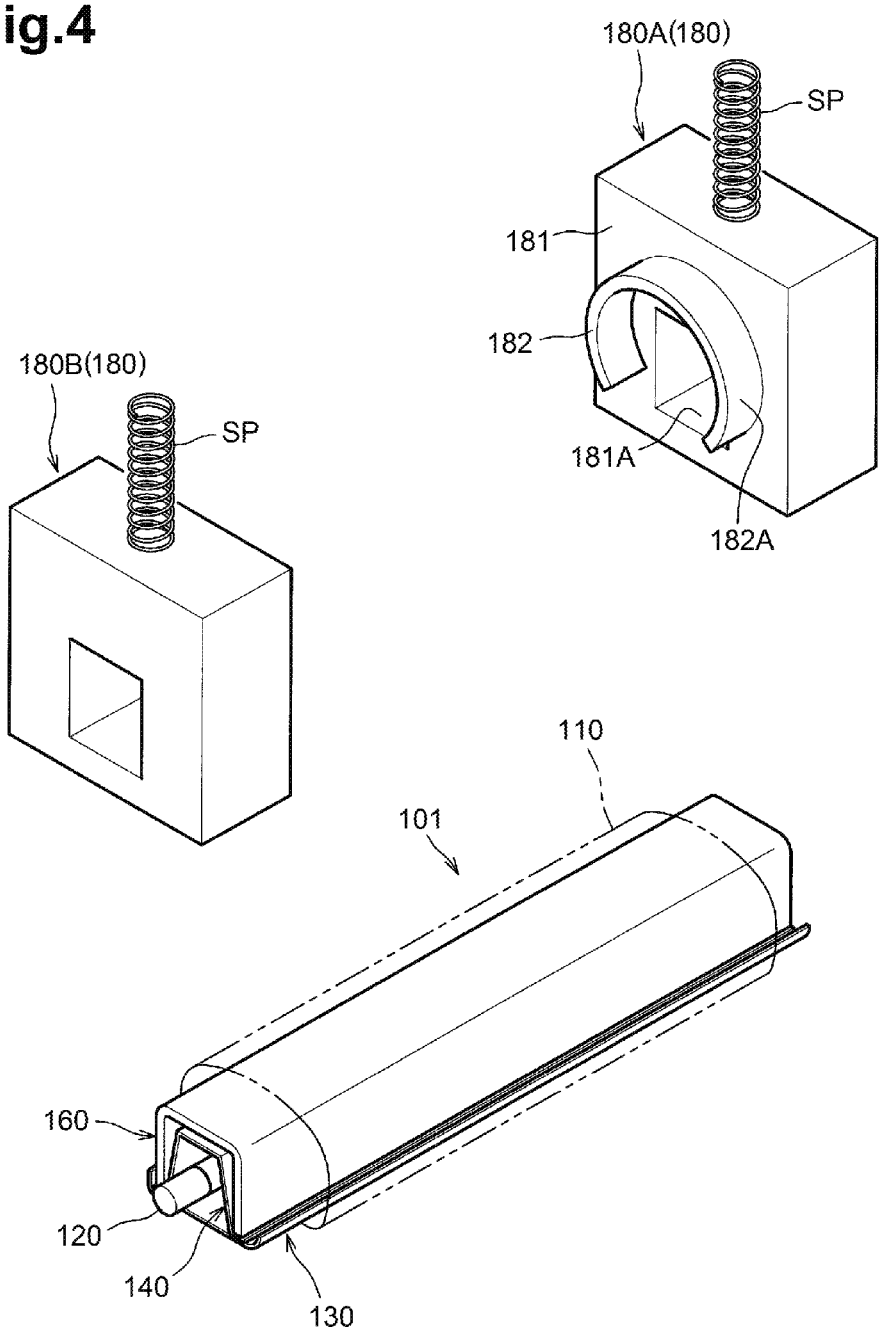
FIG. 4 is a perspective view of side guides of a heating unit.

As shown in FIG. 4, opposite side guides 180 are configured to guide the endless belt 110 and sandwich the endless belt 110 longitudinally. In other words, an inner peripheral surface of the endless belt 110 is guided at one longitudinal end thereof by the first side guide 180A and at the other longitudinal end thereof by the second side guide 180B.

Each of the side guides 180 includes a guide body 181 for supporting the stay 160 and the like, and an inner-periphery guide 182 for guiding the inner peripheral surface of the endless belt 110.

The guide body 181 has a support hole 181A formed therethrough longitudinally. A corresponding one end of the stay 160 is fixedly supported in the support hole 181A. A metal plate (not shown) is provided in the support hole 181A to support a corresponding one of the halogen lamp 120.

The inner-periphery guide 182 is a wall arcuate in cross section and protruding longitudinally from an inner surface of the guide body 181. An outer peripheral surface of the inner-periphery guide 182 guides, as a guide surface 182A, the inner peripheral surface of the endless belt 110.

Each of the side guides 180 is pressed downward by a coil spring SP. The side guides 180 pressed downward by the coil springs SP generate a pressing force to be applied downward to longitudinal opposite end portions of the stay 160. The pressing force is transmitted from the stay 160, via the reflective plate 140, to longitudinal opposite ends of the nip plate 130 and then to longitudinal opposite ends of the pressure roller 150. Upon receipt of the pressing force, the pressure roller 150 generates an upward reaction force against the pressing force. This reaction force is transmitted, via the endless belt 110, to the nip plate 130.

In the other way round, the longitudinal opposite ends of the pressure roller 150 may be pressed upward by urging members, e.g., springs, respectively. A pressing force from the pressure roller 150 may be applied to the stay 160, via the endless belt 110, the nip plate 130, and the reflective plate 140.

Figure 7A:
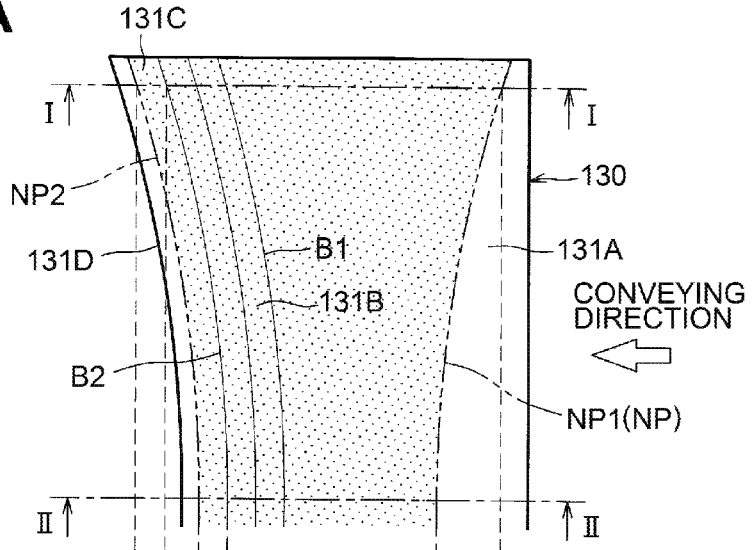
FIG. 7A is a schematic diagram showing relation between a downstream end of a nip portion, a recessed portion of the nip plate, and the corner of the nip plate.

In such a configuration that longitudinal opposite ends of one of the nip plate 130 and the pressure roller 150 urge the other, the nip plate 130 is deformed to be arced with its longitudinal center portion further upward than its longitudinal end portions. When the nip plate 130 is deformed in this way, the nip portion NP is formed into a shape hatched with dots, as shown in FIGS. 6 and 7A. Upstream and downstream ends of the nip portion NP are arced such that the nip portion NP has a reverse crown shape. In other words, the upstream end NP1 of the nip portion NP is arced with its longitudinal center portion further downstream than its longitudinal end portions, and the downstream end NP2 of the nip portion NP is arced with its longitudinal center portion further upstream than its longitudinal end portions.

The recessed portion 131B and the corner 131D, each of which is arced with its longitudinal center portion further upstream than its longitudinal end portions, extend along the downstream end of the nip portion NP. More specifically, the recessed portion 131B is positioned upstream of the downstream end NP2 of the nip portion NP, and the corner 131D is positioned downstream of the downstream end NP2 of the nip portion NP.

Figure 7B:
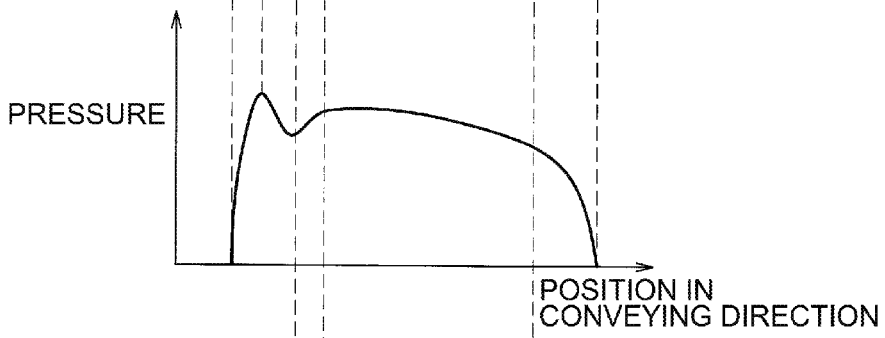
FIG. 7B is a cross-sectional view taken along line I-I of FIG. 7A.
Figure 7C:
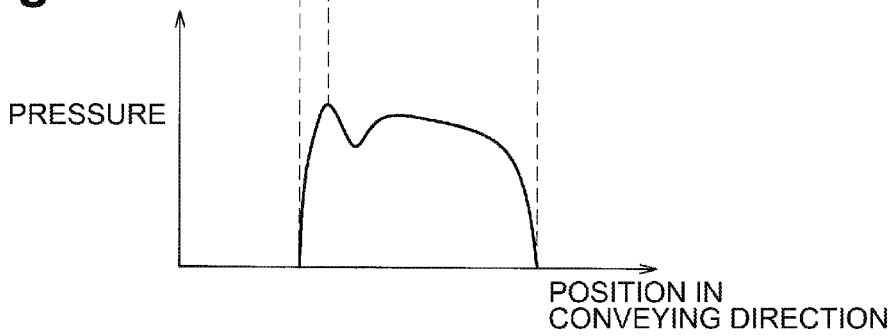
FIG. 7C is a cross-sectional view taken along line II-II of FIG. 7A.

FIG. 7B is a schematic diagram showing pressure distribution of the nip portion NP at a cross section, taken along line I-I, of a longitudinal end of the nip plate 130. The line I-I is perpendicular to the longitudinal direction of the nip plate 130. FIG. 7C is a schematic diagram showing pressure distribution of the nip portion NP at a cross section, taken along line II-II, of a longitudinal center portion of the nip plate 130. The line II-II is perpendicular to the longitudinal direction of the nip plate 130. As shown in FIGS. 7B and 7C, the pressure increases sharply in the vicinity of the upstream end NP1 of the nip portion NP, and gradually increase in a zone from the vicinity of the upstream end NP1 toward the upstream end B1 of the recessed portion 131B. Then, the pressure decreases sharply in a zone from the upstream end B1 toward the bottom of the recessed portion 131B. The pressure increases sharply in a zone from the bottom of the recessed portion 131B toward the downstream end B2 of the recessed portion 131B and hits a peak in the vicinity of the downstream end B2. Then, the pressure decreases sharply in a zone from the vicinity of the downstream end B2 toward the downstream end NP2 of the nip portion NP.

When a pressure peak, before which the pressure in the nip portion NP increases sharply and after which the pressure decreases sharply, is created, a portion of the sheet P once pressed strongly against the endless belt 110 is likely to be readily separated from the sheet P upon release of the pressure. The portion of the sheet P to which a high pressure is applied is formed into an arc shape along the downstream end NP2 of the nip portion NP. This may reduce variation in a distance between the arc-shaped portion of the sheet P and the downstream end NP2 of the nip portion NP, across longitudinally distinct positions of the arc-shaped portion of the sheet P. Accordingly, longitudinally distinct positions of the arc-shaped portion of the sheet P, which has improved separability after receiving high pressure, pass through the downstream end NP2 substantially simultaneously and moves toward the corner 131D which becomes the separation point. Thus, longitudinally distinct positions of the arc-shaped portion of the sheet P, which has equal separability, pass through the corner 131D substantially simultaneously and are separated from the endless belt 110 substantially simultaneously.

With the above-described configuration, the illustrative embodiment provides the following technical effects. The corner 131D, which becomes the separation point of the sheet P, and the downstream end NP2 of the nip portion NP are each arced with its longitudinal center portion further upstream than its longitudinal end portions. This may reduce variation, across the longitudinal direction of the nip plate 130, in a distance between the corner 131D and the downstream end NP2 in the conveying direction, and eventually reduce variation in quality of an image fixed on the sheet P. Especially, this may reduce uneven gloss of an image on glossy paper.

The recessed portion 131B having the downstream end B2, which has a curvature radius smaller than the curvature radius of the first flat portion 131A, is positioned between the first flat portion 131A and the corner 131D. Thus, a pressure peak is created upstream of the corner 131D which becomes the separation point, thereby improving separability of the sheet P.

The downstream end B2, which creates a pressure peak, is arced with its longitudinal center portion further upstream in the conveying direction than its longitudinal end portions, such that the corner 131D is equidistant from the downstream end B2 in the conveying direction, across the longitudinal direction of the nip plate 130. This may reduce variation, across the longitudinal direction of the nip plate 120, in a distance between the pressure peak and the separation point in the conveying direction, and eventually reduce variation in quality of an image fixed on the sheet P. Especially, this may reduce uneven gloss of an image on glossy paper.

The nip plate 130 is made of metal. Thus, the nip plate 130 shaped as shown in FIG. 3 may be readily formed by drawing a metal sheet.

The support surfaces 162A, 163A of the stay 160 is formed to extend substantially straight longitudinally. The stay 160 having a relatively simple shape may be readily formed.

Another illustrative embodiment will be described. It is noted that, in the following description, elements similar to or identical those illustrated and described in the above-described illustrative embodiment are designated by similar numerals, and thus the description thereof can be omitted for the sake of brevity.

Figure 8:
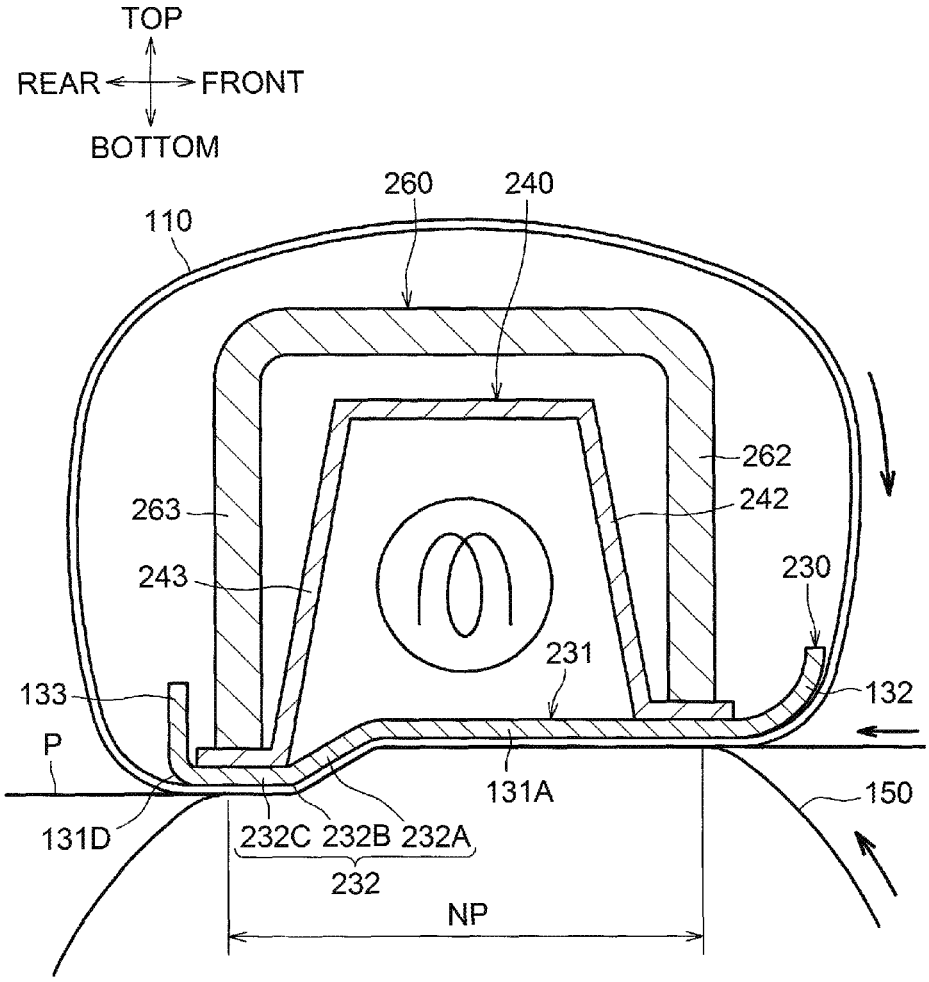
FIG. 8 is a cross-sectional view of a fixing device according to another illustrative embodiment.

In the above-described illustrative embodiment, the nip plate 130 includes the recessed portion 131B to create a pressure peak. However, in another illustrative embodiment, as shown in FIG. 8, a base 231 of a nip plate 230 may be formed to be stepped to create a pressure peak. More specifically, in the illustrative embodiment shown in FIG. 8, the base 231 includes a first flat portion 131A and a corner 131D similarly to the above-described illustrative embodiment. The base 231 further includes a connecting portion 232 (as an example of a third portion) which connects the first flat portion 131A and the corner 131D.

The connecting portion 232 is positioned upstream of the corner 131D and downstream of the first flat portion 131A in a conveying direction of a sheet P, and extends downward (toward a pressure roller 150) from the first flat portion 113A. The first flat portion 131A and the connecting portion 232 sandwich an endless belt 110 against the pressure roller 150.

The connecting portion 232 includes an upstream wall 232A, a downstream wall 232C, and a second corner 232B. The upstream wall 232A extends diagonally rearward and downward from a downstream end of the first flat portion 131A. The downstream wall 232C extends upstream substantially horizontally from an upstream end of the corner 131D. The second corner 232B connects the upstream wall 232A and the downstream wall 231C. The upstream wall 232A continues from the downstream end of the first flat portion 131A. The downstream wall 232C continues from the upstream end of the corner 131D.

Rear walls 243, 263 of a reflective plate 240 and a stay 260, respectively, are positioned on the downstream wall 232C which is stepped down from the first flat portion 131A, and extend further downward than front walls 242, 262.

Figure 9:
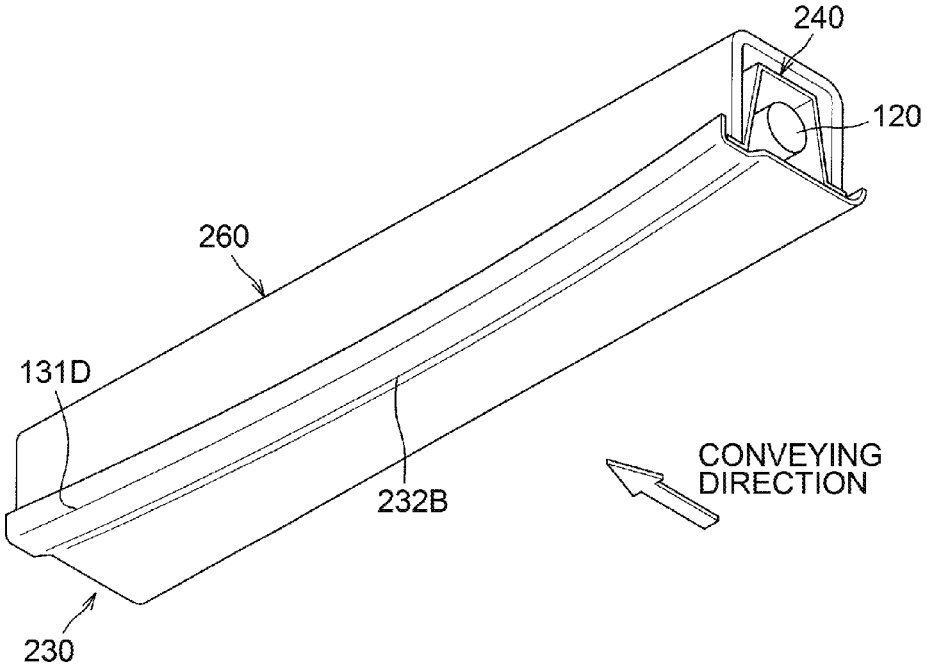
FIG. 9 is a bottom perspective view of a nip plate and other components of a heating unit according to the other illustrative embodiment.

A lower surface of the second corner 232B has a curvature radius smaller than the curvature radius of a lower surface of the first flat portion 131A. This allows the second corner 232B to create a pressure peak. As shown in FIG. 9, the second corner 232B, which creates a pressure peak, and the corner 131D, which becomes a separation point, are each arced with its longitudinal center portion further upstream in the conveying direction than its longitudinal end portions.

Figure 10:
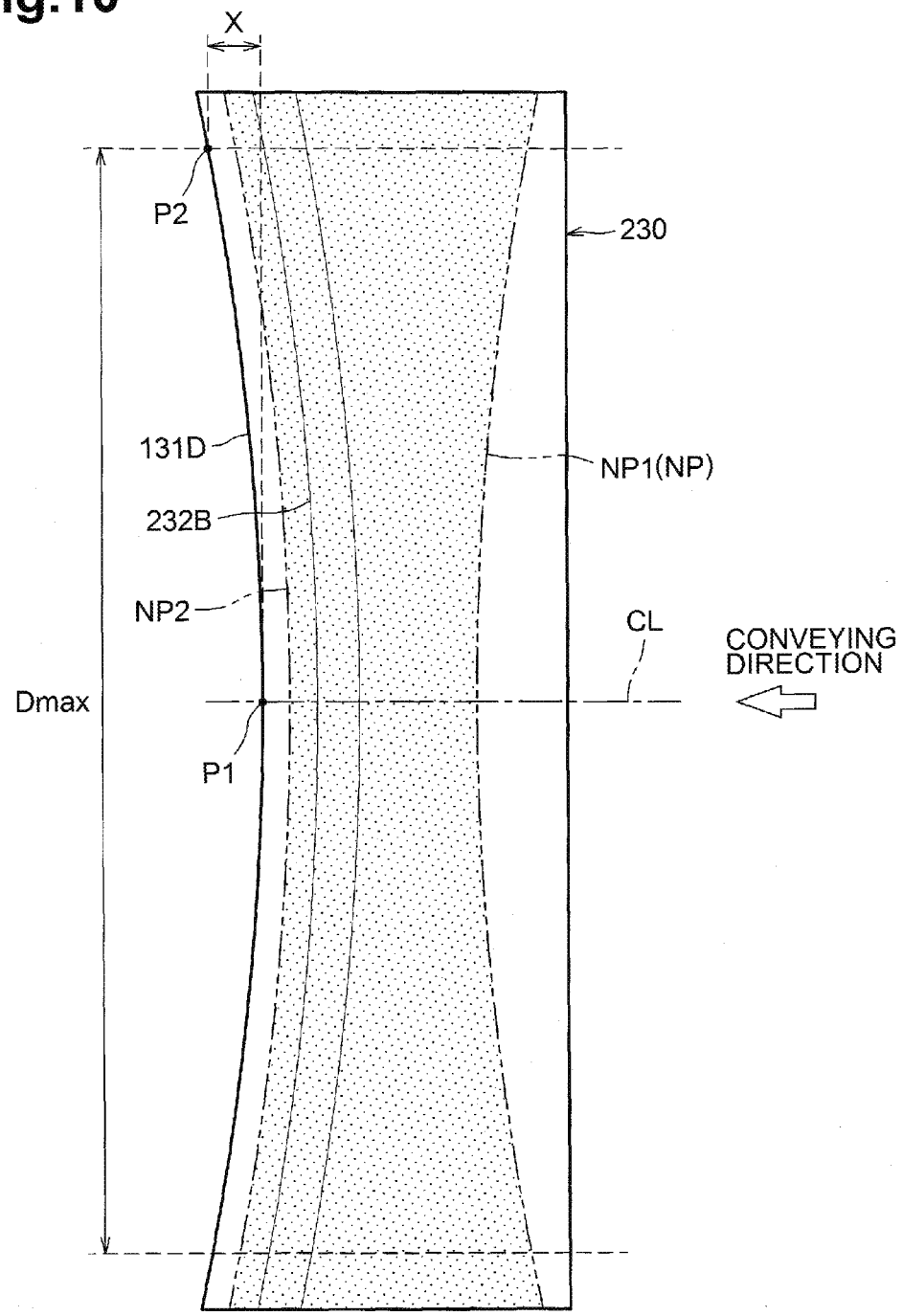
FIG. 10 is a schematic diagram showing relation between a second corner of the nip plate and a downstream end of a nip portion according to the other illustrative embodiment.

Also in this illustrative embodiment, a pressure peak is created by the second corner 232B, thereby improving separability of a sheet P. As shown in FIG. 10, the above-described configuration of the second corner 232B and the corner 131D may reduce variation, across the longitudinal direction of the nip plate 230, in a distance between the pressure peak and the separation point in the conveying direction, and eventually reduce variation in quality of an image fixed on the sheet P.

In this illustrative embodiment, the crown amount CR (X/Dmax) may be in a range from 0.001 to 0.5, or in a range from 0.005 to 0.3, or in a range from 0.01 to 0.1.

Figure 11:
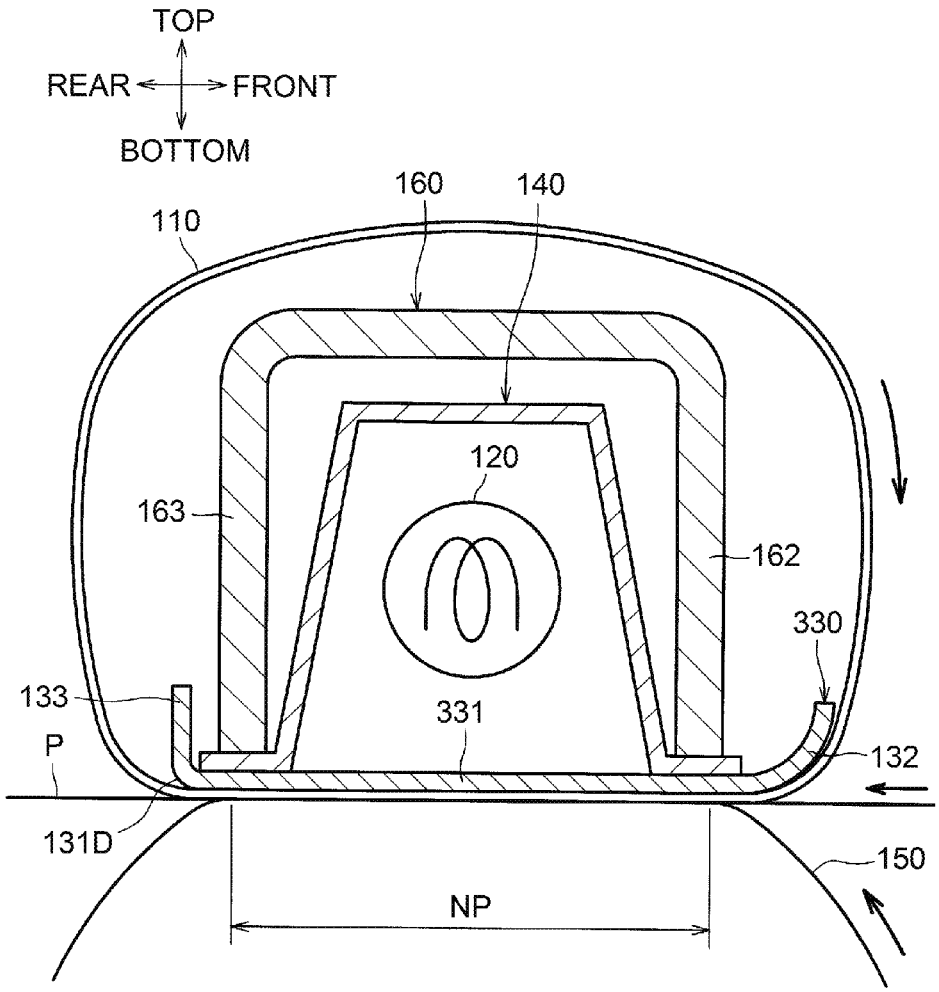
FIG. 11 is a cross-sectional view of a fixing device according to still another illustrative embodiment.

In each of the above-described illustrative embodiments, the nip plate 130, 230 includes a portion B2, 232B for creating a pressure peak. However, in still another illustrative embodiment, as shown in FIG. 11, a nip plate 330 may not include a portion for creating a pressure peak. More specifically, in the illustrative embodiment shown in FIG. 11, the nip plate 330 includes a base 331 (as an example of a first portion). The nip plate 330 further includes a corner 131D and flanges 132, 133 similarly to the illustrative embodiment shown in FIG. 2.

The base 331 is a flat plate-like portion substantially perpendicular to a top-bottom direction, and extends in a front-rear direction from a front wall 162 to a rear wall 163 of a stay 160. The base 331 and a pressure roller 150 sandwich an endless belt 110 therebetween, thereby forming a nip portion NP between the endless belt 110 and the pressure roller 150.

Figure 12:
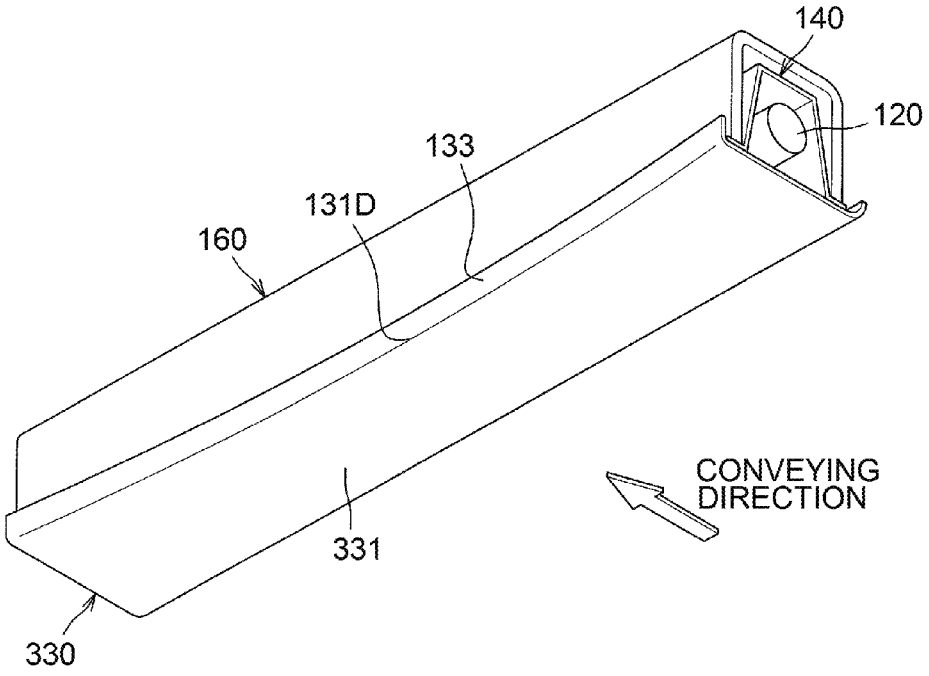
FIG. 12 is a bottom perspective view of a nip plate and other components of a heating unit according to the other illustrative embodiment.
Figure 13:
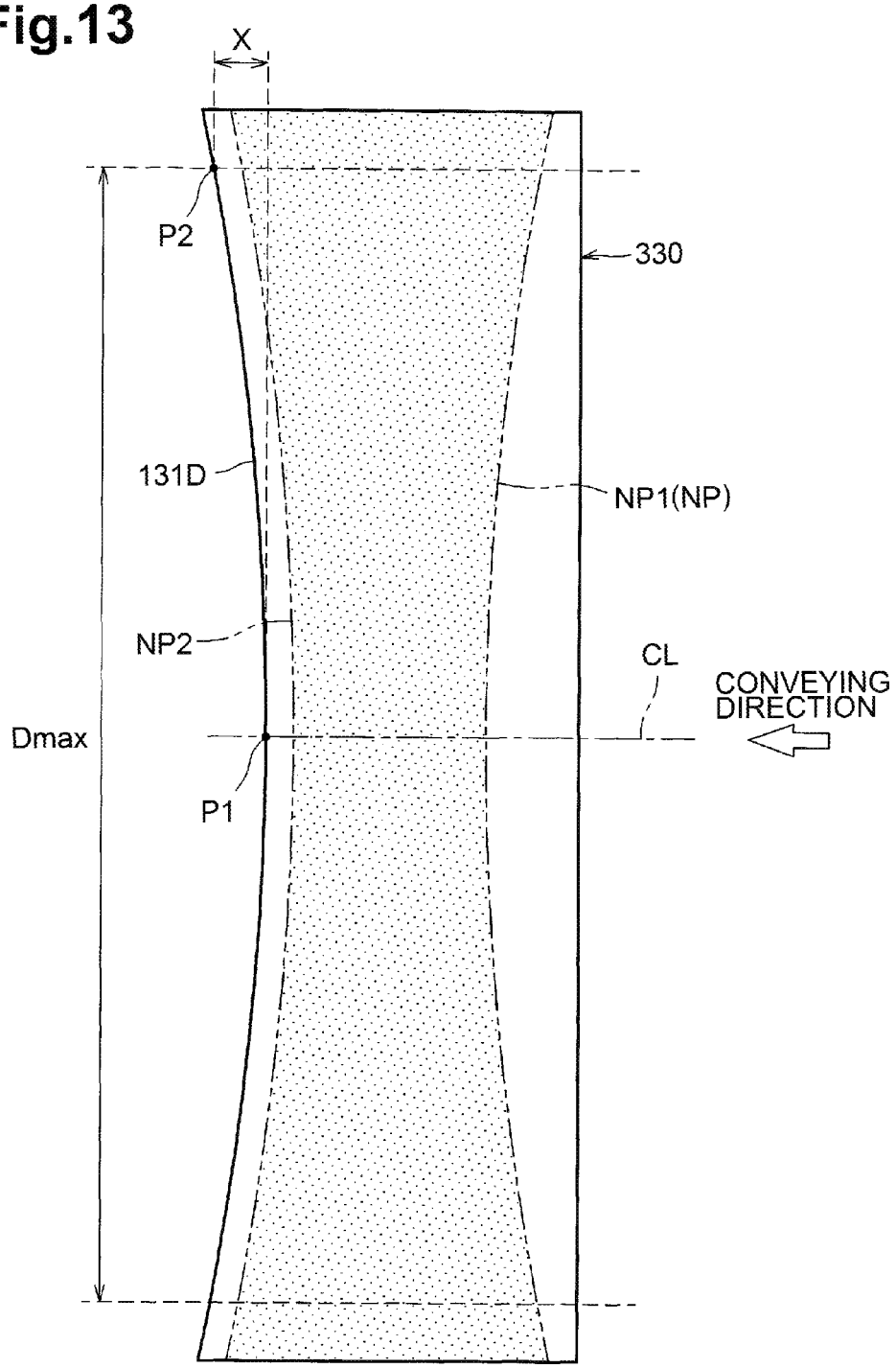
FIG. 13 is a schematic diagram showing relation between a corner of the nip plate and a downstream end of a nip portion according to the other illustrative embodiment.

The corner 131D is bent upward from a downstream end of the base 331 and, as shown in FIG. 12, is arced with its longitudinal center portion further upstream in a conveying direction of a sheet P than its longitudinal end portions. As shown in FIG. 13, this configuration may reduce variation, across the longitudinal direction of the nip plate 330, in a distance in the conveying direction between the corner 131D, which becomes a separation point, and a downstream end NP2 of the nip portion NP, and eventually reduce variation in quality of an image fixed on a sheet P.

In this illustrative embodiment, the crown amount CR (X/Dmax) may be in a range from 0.001 to 0.5, or in a range from 0.005 to 0.3, or in a range from 0.01 to 0.1.

Each of the above-described illustrative embodiments shows, but is not limited to, the halogen lamp 120 as an example of a heater. For example, a carbon heater, a ceramic heater, or an induction heater may be used instead. The heater may be disposed outside the endless belt 110, instead of inside the endless belt 110.

Each of the above-described illustrative embodiments shows, but is not limited to, the nip plate 130 as an example of a nip member. The nip member may be a thick member (shaped like a block or a pad), instead of a plate-like member. The reflective member may also be a thick member, instead of a plate-like member such as the reflective plate 140. The nip plate 120, 220, 330 may be a resin plate or a ceramic base coated with glass or resin, instead of a metal plate.

Each of the above-described illustrative embodiments shows, but is not limited to, the pressure roller 150 as an example of a backup member. For example, a belt-like pressing member may be used, instead.

Each of the above-described illustrative embodiments shows, but is not limited to, the coil spring SP as an example of an urging member. For example, a torsion spring or a leaf spring may be used, instead.

Each of the above-described illustrative embodiments shows, but is not limited to, a sheet P, as an example of a recording sheet, such as cardboard, a postcard, and thin paper. For example, an OHP sheet may be used.

What is claimed is:

1. A fixing device comprising:

an endless belt;

a nip member disposed inside the endless belt and elongated in a longitudinal direction; and a backup member sandwiching the endless belt against the nip member to form a nip portion at which the backup member and the endless belt are in contact with each other and are configured to convey a recording sheet in a conveying direction perpendicular to the longitudinal direction, wherein a downstream end of the nip portion in the conveying direction is arced with a longitudinal center portion thereof further upstream than longitudinal end portions thereof, wherein the nip member includes a first portion sandwiching the endless belt against the backup member, and a second portion positioned downstream of the first portion in the conveying direction and bent in a direction away from the backup member, the second portion being arced with a longitudinal center portion thereof further upstream in the conveying direction than longitudinal end portions thereof, and wherein the nip member includes a third portion positioned upstream of the second portion and downstream of the first portion in the conveying direction, the third portion extending from the first portion toward the backup member and sandwiching the endless belt against the backup member, and the third portion including a corner having a curvature radius smaller than a curvature radius of the first portion.

2. The fixing device according to claim 1, wherein the corner of the third portion of the nip member is arced with a longitudinal center portion thereof further upstream in the conveying direction than longitudinal end portions thereof.

3. The fixing device according to claim 1, wherein the third portion of the nip member extends upstream in the conveying direction continuously from the second portion of the nip member.

4. The fixing device according to claim 1, wherein the third portion of the nip member extends downstream in the conveying direction continuously from the first portion of the nip member.

5. The fixing device according to claim 1, wherein the nip member comprises a metal plate.

6. The fixing device according to claim 1, further comprising a support member disposed opposite to the backup member relative to the nip member and having a support surface configured to support the nip member, the support surface extending, in the longitudinal direction, between longitudinal ends of the nip member.

7. A fixing device comprising:

an endless belt;

a nip member disposed inside the endless belt and elongated in a longitudinal direction; and a backup member sandwiching the endless belt against the nip member to form a nip portion at which the backup member and the endless belt are in contact with each other and are configured to convey a recording sheet in a conveying direction perpendicular to the longitudinal direction, wherein a downstream end of the nip portion in the conveying direction is arced with a longitudinal center portion thereof further upstream than longitudinal end portions thereof, wherein the nip member includes a first portion sandwiching the endless belt against the backup member, and a second portion positioned downstream of the first portion in the conveying direction and bent in a direction away from the backup member, the second portion being arced with a longitudinal center portion thereof further upstream in the conveying direction than longitudinal end portions thereof, wherein the nip member includes a third portion positioned downstream of the first portion in the conveying direction, the third portion being recessed in the direction away from the backup member and including a corner having a curvature radius smaller than a curvature radius of the first portion, and wherein the third portion of the nip member is arced with a longitudinal center portion thereof further upstream in the conveying direction than longitudinal end portions thereof.

8. A fixing device comprising:

an endless belt;

a nip member disposed inside the endless belt and elongated in a longitudinal direction;

a backup member sandwiching the endless belt against the nip member to form a nip portion at which the backup member and the endless belt are in contact with each other and are configured to convey a recording sheet in a conveying direction perpendicular to the longitudinal direction;

a heater configured to heat the endless belt; and a reflective member configured to reflect radiant heat from the heater to the nip member, wherein a downstream end of the nip portion in the conveying direction is arced with a longitudinal center portion thereof further upstream than longitudinal end portions thereof, and wherein the nip member includes a first portion sandwiching the endless belt against the backup member, and a second portion positioned downstream of the first portion in the conveying direction and bent in a direction away from the backup member, the second portion being arced with a longitudinal center portion thereof further upstream in the conveying direction than longitudinal end portions thereof.

9. A fixing device comprising:

an endless belt;

a nip member disposed inside the endless belt and elongated in a longitudinal direction; and a backup member sandwiching the endless belt against the nip member to form a nip portion at which the backup member and the endless belt are in contact with each other and are configured to convey a recording sheet in a conveying direction perpendicular to the longitudinal direction, wherein the nip member includes:

a first flat portion sandwiching the endless belt against the backup member and having a first curvature radius;

a first corner positioned downstream of the first flat portion in the conveying direction and bent in a direction away from the backup member; and a second corner positioned between the first flat portion and the first corner in the conveying direction and sandwiching the endless belt against the backup member, the second corner having a second curvature radius smaller than the first curvature radius, and wherein each of the first corner and the second corner being arced with a longitudinal center portion thereof further upstream in the conveying direction than longitudinal end portions thereof, such that the first corner is equidistant from the second corner in the conveying direction across the longitudinal direction of the nip member.

10. The fixing device according to claim 9, wherein the backup member extends parallel to the longitudinal direction of the nip member, and longitudinal opposite ends of one of the backup member and the nip member are urged to the other of the backup member and the nip member.

11. The fixing device according to claim 9, wherein a downstream end of the nip portion is positioned, in the conveying direction, downstream of the second corner of the nip member and upstream of the first corner of the nip member.

12. The fixing device according to claim 9, wherein the nip member further includes a second flat portion immediately upstream of the first corner in the conveying direction and parallel with the first flat portion, and a diagonal portion immediately upstream of the second flat portion in the conveying direction and diagonal relative to the second flat portion, the second flat portion and the diagonal portion defining the second corner.

13. The fixing device according to claim 12, further comprising a support member disposed opposite to the backup member relative to the nip member and having a support surface configured to support the nip member, the support surface facing the second flat portion.

* * * * *